US005728196A

United States Patent [19]

Martin et al.

[11] Patent Number: 5,728,196

[45] Date of Patent: Mar. 17, 1998

[54] PROCESS FOR WASTE THERMOLYSIS

[75] Inventors: Gerard Martin; Eric Marty, both of Rueil-Malmaison, France

[73] Assignee: Institut Francais du Petrole, Rueil-Malmaison, France

[21] Appl. No.: 502,314

[22] Filed: Jul. 13, 1995

[30] Foreign Application Priority Data

Jul. 13, 1994 [FR] France ..... 94 08767

[51] Int. Cl.[6] ..... C22B 7/00; C22B 21/00

[52] U.S. Cl. ..... 75/403; 201/17

[58] Field of Search ..... 75/403; 210/17

[56] References Cited

U.S. PATENT DOCUMENTS 5,302,254 4/1994 Martin et al. ..... 201/25
5,505,822 4/1996 Martin et al. ..... 201/25

FOREIGN PATENT DOCUMENTS 0 302 310 2/1989 European Pat. Off. .
0 312 742 4/1989 European Pat. Off. .
547 648 12/1922 France .
2 678 850 1/1993 France .
41 36 438 5/1993 Germany .

*Primary Examiner*—Melvyn Andrews
*Attorney, Agent, or Firm*—Antonelli, Terry, Stout, & Kraus, LLP

[57] ABSTRACT

The present invention relates to a process and system for thermal waste treatment. The method according to the invention comprises subjecting the waste to thermolysis in a furnace to produce from the waste thermolysis gases and carbon containing solids; purifying the carbon containing solids into purified carbon containing solids which contain pollutants; using part of the thermolysis gases as fuel which is burned to heat the waste in the furnace; burning in a cyclone furnace at least part of the purified carbon containing solids containing pollutants to produce hot gases and to immobilize the pollutants present in the purified carbon containing solids into solids containing the pollutants; and providing the hot gases to an energy recovery device and using the energy recovery device to recover energy from the hot gases.

25 Claims, 3 Drawing Sheets

35
14
13
12
11
F
15
36
SCE
GT2
Air
Air
37
DB
GT1
GT
2
0
DP
1
4
5
3
SC
6
CF
10

SC 19
20
22
16
17
18
21
25
27
26
31
TC
29
24
23
28
30

PROCESS FOR WASTE THERMOLYSIS

BACKGROUND OF THE INVENTION

Field of the invention

The present invention relates to the field thermal waste treatment, which treatment comprises in particular The waste that can be treated according to the invention is preferably solid, heterogeneous, and nonhazardous.

The waste thus consists primarily of household trash but also of ordinary industrial waste such as automobile grinding residues, old tires, plastic scrap, industrial sludge or sludge from purification stations, etc.

As will better emerge from the description hereinbelow, the invention advantageously allows waste products highly variable sizes to be treated at highly variable rates.

DESCRIPTION OF THE PRIOR ART

In the field of thermal waste treatment, systems designed for thermolysis that also, for the most part, allow treatment of either thermolysis gases or the solids produced by thermolysis are already known.

Examples of documents relating to devices directed to treatment of thermolysis solids are German Patent DE 4308551 and French Applications FR 2,679,009 and FR 2,678,850, both assigned to the assigned.

German Patent DE 4308551 has the feature of the carbon-rich fine fraction of solid residues to produce a synthesis gas and slag.

The two above-cited French patent applications disclose in particular washing of solids produced by thermolysis.

Other documents more particularly disclose treatment of thermolysis effluents or gases; in this category, French Patent Application FR 2,668,774 and document EP-A1 -0302310 are included According to French Application FR 2,668,774, hot treatment of gases in the thermolysis furnace itself can be carried out; in particular this allows direct reuse of pyrolysis gases without further treatment. More particularly, the pyrolysis gases are used to heat the waste directly or indirectly.

Document EP-A1-0302310 discloses in particular very-high-temperature combustion of combustion effluents.

This prior art, as can be seen, improves the thermolysis process in terms of effects on the gaseous or solid discharges it generates. Increasingly strict environmental standards in the draft stage or already in effect in most industrialized countries compel operators to implement increasingly clean systems. Releases of NOx and MCI, HF, $SO_2$, Co, fly ash, clinker, etc. are in particular subject to increasingly strict regulation.

However, the prior art cited improves only one or the other of the thermolysis products, namely either gaseous effluents or solids.

Moreover, in terms of energy, both energy consumption and the overall energy balance remain underestimated parameters that are often ignored in the prior art.

SUMMARY OF THE INVENTION

The goal of the present invention is to remedy these drawbacks. In particular the invention, leads to better use of the energy content of the waste.

In addition, the present invention minimizes self-consumption of the energy necessary for carrying out the process.

Thus, the present invention relates to a thermal waste treatment process comprising in particular:

thermolysis of the waste;

utilization of thermolysis and gases as fuel for thermolysis;

after-treatment of the solids produced by thermolysis.

According to the invention:

the solid fuels emerging from after-treatment of thermolysis solids can be burned at least in part in a cyclone furnace and/or stored;

the hot gases emerging from the cyclone furnace can supply at least one energy recovery device.

In particular, the thermolysis gases can be burned at least partially as fuel either in the cyclone furnace or in at least one of the energy recovery device.

According to the invention, after-treatment consists essentially of purifying carbon-containing solids.

The process according to the invention may consist additionally of controlling the quantity of solid fuels burned in the cyclone furnace and the quantity of solid fuels stored, as a function of the energy balance.

The present invention also relates to a thermal waste treatment system comprising:

a thermolysis furnace;

at least one thermolysis gas combustion device;

an energy recovery device; and a thermolysis solids after-treatment device.

Advantageously, the system also comprises:

a cyclone furnace supplied by at least a portion of the solid fuels coming from the after-treatment device, and a means designed to conduct the hot gases emerging from the cyclone furnace to the energy recovery device.

More precisely, the thermolysis gas combustion means includes said cyclone furnace.

According to the invention, the thermolysis gas combustion device and the energy recovery device are arranged such that the combustion device is supplied by thermolysis gases and the energy recovery device is supplied by the effluents from the combustion device and, under certain operating conditions, by the hot gases from the cyclone furnace.

The solids after-treatment device can advantageously carry out purification of the carbon-containing solids.

In addition, the system according to the invention may comprise a filter for filtering the fumes coming from the energy recovery device, with an outlet from filter filtration means being connected to an inlet to the cyclone furnace.

BRIEF DESCRIPTION OF THE DRAWINGS

Other characteristics, improvements, and advantages of the invention will appear more clearly from reading the description hereinbelow, provided for illustration and not limitation, with reference to the attached drawings wherein.

DESCRIPTION OF THE PREFERRED EMBODIMENTS

Figure 1:
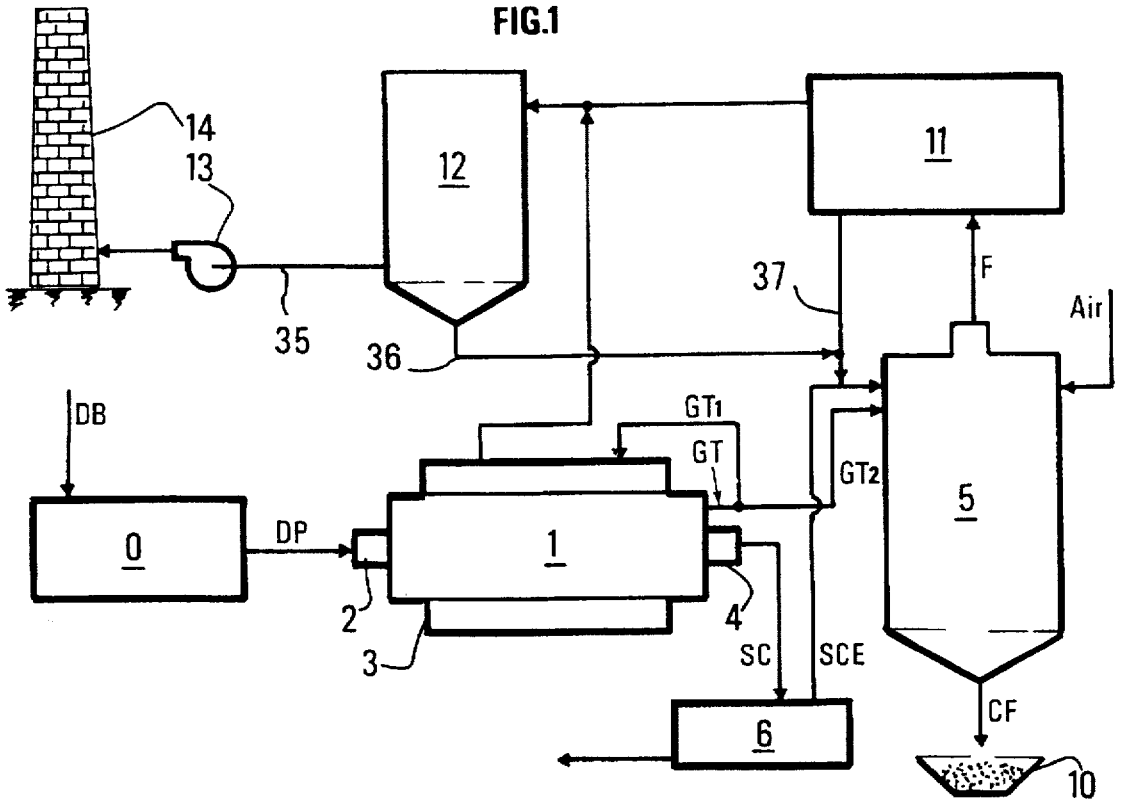
FIG. 1 is a functional schematic representation of an embodiment of the invention.

According to FIG. 1, the raw waste referenced (DB) can first undergo pretreatment device O, the complexity of which depends on the type of waste treated, and which uses traditional techniques: grinding, partial sorting, iron removal, drying, etc. The purpose of this pretreatment stage is to recover easily separable and recyclable materials, and to homogenize the waste. This part of the system is not inventive per se since the techniques employed have been used for a long time in the waste treatment industry. Also, this treatment does not have an obligatory nature.

Following this pretreatment, the pretreated waste (DP) is introduced into a rotary furnace 1 with indirect internal or external heating via a device 2 which provides a seal between the furnace and the outside thus preventing any air from being admitted into the furnace. Device 2 which provides this seal can be an Archimedes screw or a device for introducing the charge by compacted bale.

Without departing from the framework of the invention, the rotary furnace can be like that disclosed in French Patent Application Reg. 94/066660, with indirect internal heating.

As it progresses in furnace 1, the waste undergoes thermal decomposition resulting in formation of a gas phase (GT) and a solid residue rich in carbon-containing substances (SC). The waste and gases resulting from thermal decomposition circulate in the furnace co-currently. This operation is conducted at a temperature between 200° and 800° C., preferably between 350° and 600° C. The rotary furnace is surrounded by a double jacket 3 equipped with a combustion device such as burners (not numbered) which provide the necessary thermal power for heating the waste to be generated. The burners can be supplied in known fashion by a portion GT1 of the thermolysis gases or by another other fuel such as fuel oil or natural gas.

The reaction conditions of the thermolysis allow retention in the carbon-containing solids of almost all the acid gases, particularly hydrochloric acid, produced during thermal decomposition of chlorine-containing plastics such as PVC. This self-neutralization of acid components by the basic substances always present in waste is favored, among other things, by the reducing atmosphere and the low temperatures to which the waste is subjected during thermolysis. By increasing the basic component of the waste by adding calcium or sodium absorbent, the efficiency of acid gas capture by the carbon-containing solids is enhanced. Purification of the carbon-containing solids as described below eliminates in particular the chlorine salts resulting from capture of acid gases. Likewise, since the treatment temperatures are low and thermolysis is conducted in the absence of oxygen, heavy metals are neither volatilized nor oxidized, and remain concentrated in the carbon-containing solids (SC).

As they leave rotary furnace 1, the carbon-containing solids (SC) are evacuated by a device 4 ensuring a seal from the outside (rotary valve, lock chamber with gate valves, or any other equivalent device allowing this function to be accomplished). The carbon-containing solids (SC) are routed to a purifying device 6 the purpose of which is to separate a portion of the inert materials and eliminate the soluble contaminants, particularly chlorine salts, present in the carbon-containing solids. The device for purifying carbon-containing solids 6 is described in greater detail below, in relation to FIG. 3. Following purification treatment, the purified carbon-containing solids (SCE) can be sent to a combustion device 5, in this case comprised of a molten ash cyclone furnace.

As already stated, some of the thermolysis gases (GT1) can be used to heat the rotary furnace by combustion, for example in burners located in the double jacket 3 surrounding rotary furnace 1. The excess fraction (GT2) of the thermolysis gases can be sent to a combustion device, for example the molten ash cyclone furnace 5.

Molten ash cyclone furnace 5 is a furnace designed for combustion of solid fuels with a high content of low-melting-point ash. It is characterized by high turbulence and swirling flow, so that there is a long fuel residence time and good ash retention. It operates at temperatures on the order of 1000° to 1500° C. At these temperatures, the ashes melt and flow outside the reactor in the molten state.

The advantages of this type of furnace relative to traditional combustion devices are the following: a low quantity of unburned matter due to the long residence time of the particles in the furnace, ash that is inert because it is vitrified, great compactness due to the high firing density of the system, possibilities of staging the combustion air to minimize formation of nitrogen oxides, and stable combustion even when the characteristics of the fuel vary considerably.

The inside of cyclone furnace 5 can preferably be covered with a refractory ceramic coating able to withstand temperatures on the order of 1500° C. Injection of purified carbon-containing solids (SCE) is done pneumatically by one or more rectangular or circular inlets distributed over a perimeter of the cyclone. It is also possible to inject additional combustion air and/or all or some of the excess thermolysis gas GT2 into one or more of these inlets. On a second perimeter of the cyclone furnace, other tangential inlets can be installed to effect additional injections of combustion air or gaseous fuel such as all or some of the excess thermolysis gas GT2. Finally, additional air can be injected at the upper outlet of the cyclone furnace to improve combustion efficiency.

Combustion in the molten ash cyclone furnace is optimized to minimize releases of gaseous pollutants. The distribution of combustion air between the various inlets is accordingly effected in such a way as to ensure total burnup of the purified carbon-containing solids and thermolysis gas, and to minimize formation of nitrogen oxides and unburned material. In addition, all or some of the combustion air can be preheated to facilitate achievement of high temperatures in the cyclone furnace.

The molten ash cyclone furnace advantageously allows the pollutant elements present in the purified carbon-containing solids, in particular heavy metals, to be definitively immobilized by trapping in the vitreous matrix formed when the minerals contained in the purified carbon-containing solids are melted. The temperatures obtained when the purified carbon-containing solids (SCE) and the excess thermolysis gas GT2 are burned are sufficient to melt these minerals. The ash thus melted (CF) flows out of furnace 5 and falls into a water tank 10 where it is cooled. As it cools, the ash forms solid granulates. These granulates are inert to lixiviation so that they can be recycled and reused in road or public works applications for example.

The hot fumes (F) from the combined combustion of purified carbon-containing solids and some of the thermolysis gases in cyclone furnace 5 are then sent to an energy recovery device 11 such as a heat exchanger, a boiler producing steam or hot water, or a boiler coupled to a turbine for producing electricity. Then these fumes are freed from dust in a device 12 which can be a bag filter or an electrostatic dust precipitator, and released to the atmosphere through an extractor 13 and a stack 14 via a line 35. The ashes emerging from energy recovery device 11 and dust removal device 12 are mixed with the purified carbon-containing solids then sent to cyclone furnace 5 via lines 36 and 37 respectively. The ash is vitrified in cyclone furnace 5 so that the pollutants adsorbed onto these dusts can be inertized.

Figure 2:
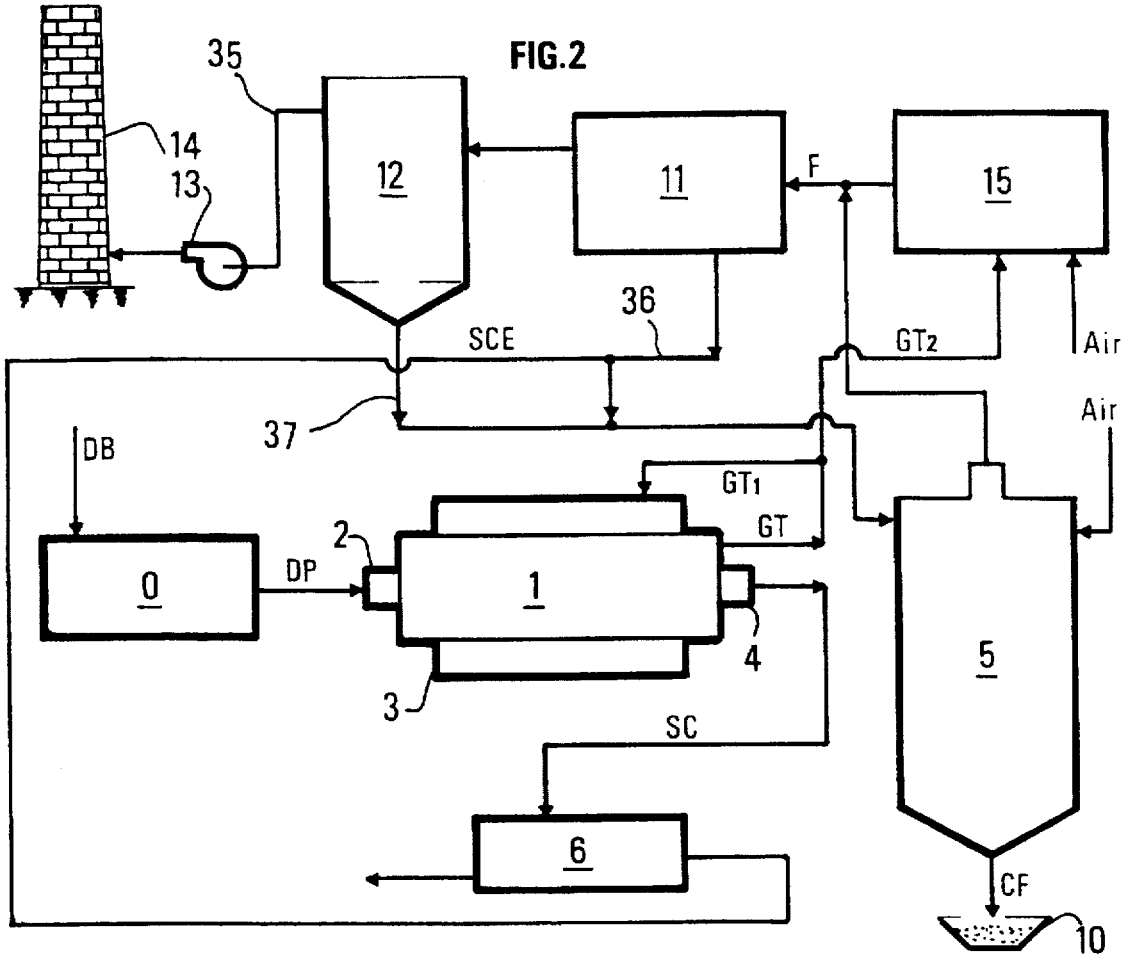
FIG. 2 is a functional schematic representation of another embodiment of the invention.

A second embodiment of the invention is shown in FIG. 2. The essential difference between the embodiment already described and the embodiment to be described now is that the purified carbon-containing solids and the waste thermolysis gases are burned in two separate devices. As in the first embodiment of the invention, some of the thermolysis gases (GT1) are used to heat the rotary furnace by combustion for example in the burners located in double jacket 3 surrounding rotary furnace 1. Here, the excess fraction (GR2) is sent to a classical combustion chamber 15 equipped with a gas burner. The configurations of the burner and the combustion chamber minimize nitrogen oxide formation when the thermolysis gases undergo combustion, and ensure destruction of all the organic compounds because the gases have a residence time of at least 2 seconds at 850° C.

The purified carbon-containing solids (SCE) are burned in a molten ash cyclone furnace 5 which has an identical design to that described above but with lower heating power, mixed with the ashes coming from dust removal device 12 and energy recovery device 11. As previously, the temperature reached during combustion of the purified carbon-containing solids is sufficient for the ashes to melt and thus trap the pollutants in the vitreous matrix. As they leave the furnace, the molten ashes (CF) flow into a water tank 10 where they are cooled and solidified such as to produce inert granulates. The combustion air is staged as described above and all or some of this air can also be preheated to improve the heat balance of the operation.

The hot fumes (F) from combustion of the thermolysis gases (GT2) in combustion chamber 15 and those from combustion of the purified carbon-containing solids (SCE) in cyclone furnace 5 are mixed and sent to an energy recovery device 11 such as a heat exchanger, a boiler producing steam or hot water, or a boiler coupled to a turbine for producing electricity. Then these fumes are filtered in a device 12 and released to the atmosphere through an extractor 13 and a stack 14. The ashes and dust emerging from energy recovery device 11 and dust removal 12 are mixed with the purified carbon-containing solids then sent to cyclone furnace 5 to be vitrified so that the pollutants adsorbed onto these dusts can be rendered inert.

The functioning of the embodiment of the invention according to FIG. 2 is more flexible than that according to FIG. 1. In particular, it is possible according to this embodiment to shut down cyclone furnace 5 when the total energy consumption is low. In this case, the purified carbon-containing solids (SCE) are not sent to cyclone furnace 5, but are stored. In a period of high energy demand (winter for example), cyclone furnace 5 operates as indicated above. The fuels stored can then be burned during this period.

This embodiment of the invention thus allows a very good match between energy demand and need.

Figure 3:
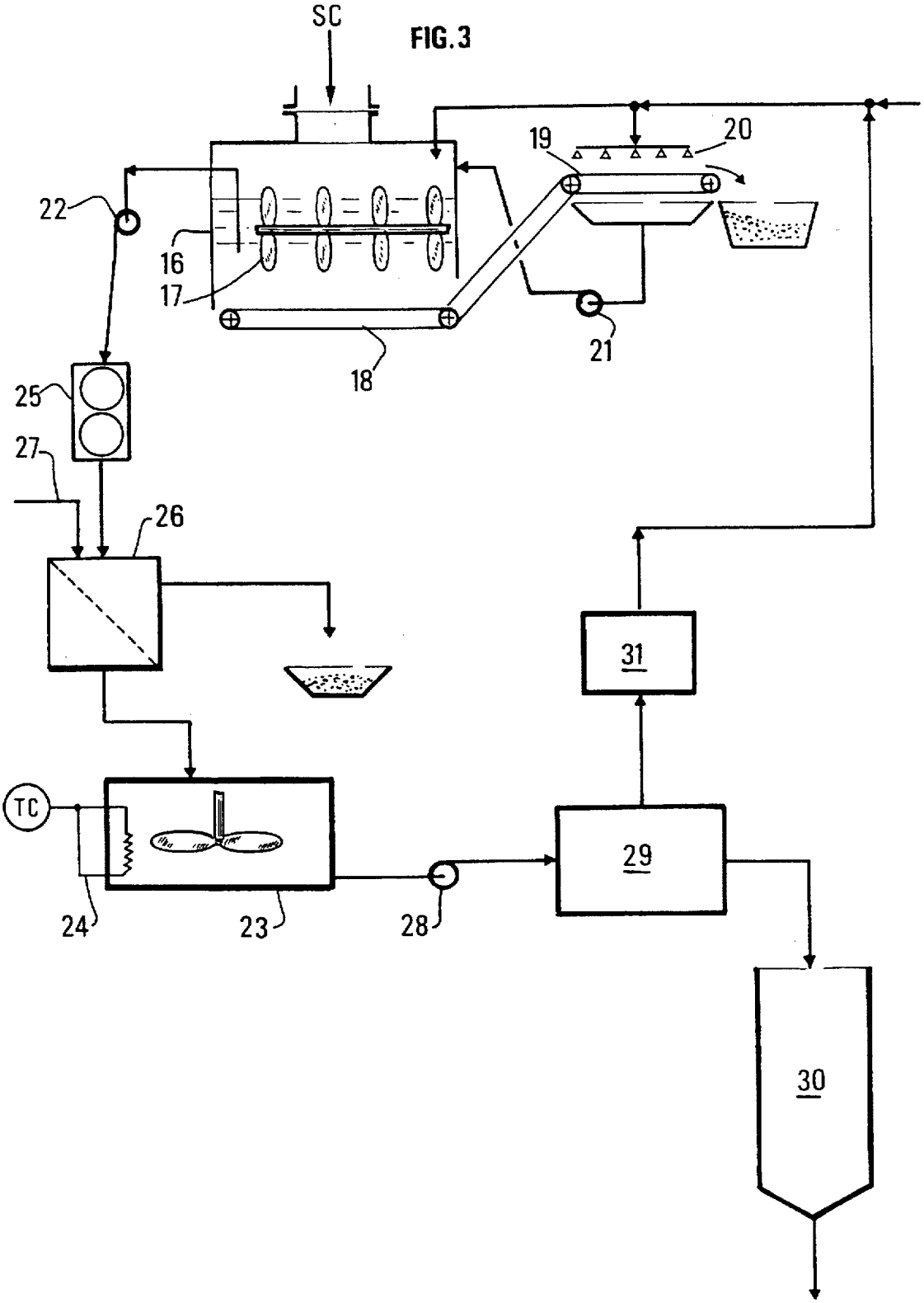
FIG. 3 is a functional schematic representation of an assembly for after-treatment of thermolysis solids according to the invention.

The carbon-containing solids purification device 6 as shown in FIG. 3 will now be described.

As they leave rotary furnace 1, the carbon-containing solids (SC) are evacuated via a sealed device 4 and fall by gravity into a tank 16 with an agitator, filled with water at room temperature, so that the solids can cool. Agitation of the mix, provided for example by a shaft on which blades 17 are mounted, is such that the heaviest particles, composed essentially of metals, minerals, or glass, settle on the bottom of the tank, while the lighter carbon-rich particles are held in suspension. A screw, a screen, a scraper, or other equivalent device 18 can be submerged in the bottom of tank 16 for continuous extraction of the minerals that have settled on the bottom of the tank.

This first tank 16 thus allows the carbon-containing solids to be cooled and some of the minerals contained in the carbon-containing solids to be separated out.

The inert minerals extracted by extraction device 18 are then rinsed by water on a vibrating screen 19 surmounted by a water sprinkler 20 in order to eliminate the carbon particles deposited on these minerals. The rinse water laden with these carbon particles can be driven by a pump 21 to first decanting tank 16.

The minerals rinsing operation can of course be carried out by means other than those just described without departing from the framework of the present invention.

Also, the mixture of water and carbon-containing solids in suspension in tank 16 is sent by a pump 22 to a second fully agitated washing tank 23 containing water held at a temperature of between 40° and 95° C, and preferably between 75° and 85° C. This temperature is kept constant in tank 23 by a temperature regulator 24 connected to an electrical resistance or any other equivalent device that keeps the water temperature at a set value. The residence time of the carbon-containing solids in tank 23 is between 15 and 120 minutes. The weight ratio between water and carbon-containing solids is between 1 and 100 and preferably between 5 and 15. This operation allows essentially the chlorine-containing salts formed in the thermolysis stage to be dissolved. The heavy metals are not dissolved and remain concentrated in the carbon-containing solids.

Before being introduced into stirring tank 23, the carbon-containing solids can be ground in a grinder 25 operating in the liquid phase to decrease the average particle size of the carbon-containing particles and speed up the washing stage. This stage can also be followed by a separation stage on a calibrated screen 26 which allows the aluminum foil contained in the carbon-containing solids (SC) to be separated out. This operation is necessary in particular when the carbon-containing solids come from thermolysis of household trash. A water sprinkler 27 is directed to the screen containing the aluminum foil in order to drive off the carbon particles deposited on the foil surfaces. The latter operation allows aluminum foil to be recovered and recycled.

When it leaves washing tank 23, the suspension of carbon-containing solids in water is pumped by a pump 28 to a filter device 29 whose purpose is to eliminate the chloride-laden water from the carbon-containing solids. This operation can be carried out with a centrifuge, a vacuum band filter, or any other filtration device that separates water from carbon-containing solids.

When they leave filtration device 29, the purified carbon-containing solids which are dry or contain only a small quantity of moisture are stored in a hopper 30. The waste water from filtration is sent if necessary to a water treatment device 32 for precipitating the chlorine-containing salts then reinjected into first decanting tank 16. Fresh makeup water is continuously added through devices 20 and 27.

In certain cases, the decanting and washing stages as described above can be carried out in the same tank, simultaneously fulfilling the functions of tanks 16 and 23, the temperature of which is held at between 40° and 95° C. The above device is then simplified.

After this purification operation, a fuel rich in carbon-containing materials but minus some of its polluting elements is available, which can be immediately burned to generate energy in the molten ash cyclone furnace or stored with a view to later combustion.

The present invention allows the energy content of waste to be used by producing a purified solid fuel and a purified gaseous fuel, and burning them.

In addition, device 6 according to the invention which purifies carbon-containing solids eliminates some of the minerals and recovers reusable materials such as aluminum. This device also allows the quality of the fuel produced to be increased by decreasing its ash content and pollutant content. Finally, it increases its heating power.

Also, the use according to the invention of a molten ash cyclone furnace with staging of the combustion air allows purified carbon-containing solids and/or all or some of the gases from waste thermolysis to be burned without discharges of polluting compounds in the gaseous or solid combustion effluents.

The waste treatment process according to the invention avoids dispersion of pollutants since almost all the pollutants are concentrated in the carbon-containing solids. Some of these pollutants are then eliminated by the purification treatment of the carbon-containing solids, and some are trapped in the inert granulates coming from combustion in the molten ash cyclone furnace.

The invention relates to a complete waste treatment system which eliminates emissions of pollutants in the fumes from combustion of thermolysis gases and carbon-containing solids, so that the only fume treatment necessary is dust removal. Thus the invention allows installation of devices treating fumes by washing, which decreases the cost of treating waste by comparison with classical techniques such as incineration.

We claim:

1. A thermal waste treatment process comprising:

subjecting waste, which is decomposable into thermolysis gases and carbon containing solids, to thermolysis in a furnace to produce from the waste thermolysis gases and carbon containing solids;

processing the carbon containing solids into carbon containing solids which also contain pollutants to be removed;

using part of the thermolysis gases as fuel which is burned to heat the waste in the furnace;

burning in a cyclone furnace at least part of the processed carbon containing solids containing pollutants to be removed to produce hot gases and solids containing the pollutants; and providing the hot gases to an energy recovery device and using the energy recovery device to recover energy from the hot gases.

2. A process in accordance with claim 1, wherein:

the thermolysis gases are used as fuel which is burned in the energy recovery device.

3. A process in accordance with claim 1, wherein:

the thermolysis gases are used as fuel burned in the cyclone furnace to produce the hot gases.

4. A process in accordance with claim 1, wherein:

the thermolysis gases are used as fuel burned in the cyclone furnace to produce the hot gases and in the energy recovery device.

5. A process in accordance with claim 1, wherein:

the processed carbon solids also contain minerals and are produced by cooling the carbon containing solids, extracting the minerals from the cooled carbon containing solids by hot washing and rinsing with water to dissolve chlorine containing salts, and separating the water from the hot washed and cooled carbon containing solids after rinsing thereof to produce the processed carbon containing solids which contain pollutants to be removed.

6. A process in accordance with claims 5, wherein:

the water used for hot washing and rinsing is recycled and used again for the hot washing and the rinsing.

7. A process in accordance with claim 5, wherein:

the carbon containing cooled solids also contain aluminum foil and are ground to produce ground carbon containing solids and the aluminum foil therein is separated therefrom.

8. A process in accordance with claim 6, wherein:

the cooled carbon containing solids also contain aluminum foil and are ground to produce ground carbon containing solids and the aluminum foil therein is separated therefrom.

9. A process in accordance with claim 1, wherein:

a part of the processed carbon containing solids are stored and a part of the processed carbon containing solids are burned in the cyclone furnace with the quantity of processed carbon containing solids being stored in accordance with a total energy consumption of the waste treatment process.

10. A process in accordance with claim 2, wherein:

a part of the processed carbon containing solids are stored and a part of the processed containing solids are burned in the cyclone furnace with the quantity of processed carbon containing solids being stored in accordance with a total energy consumption of the waste treatment process.

11. A process in accordance with claim 3, wherein:

a part of the processed carbon containing solids are stored and a part of the processed carbon containing solids are burned in the cyclone furnace with the quantity of processed carbon containing solids being stored in accordance with a total energy consumption of the waste treatment process.

12. A process in accordance with claim 4, wherein:

a part of the processed carbon containing solids are stored and a part of the processed containing solids are burned in the cyclone furnace with the quantity of processed carbon containing solids being stored in accordance with a total energy consumption of the waste treatment process.

13. A process in accordance with claim 5, wherein:

a part of the processed carbon containing solids are stored and a part of the carbon containing solids are burned in the cyclone furnace with the quantity of processed carbon containing solids being stored in accordance with a total energy consumption of the waste treatment process.

14. A process in accordance with claim 6, wherein:

a part of the processed carbon containing solids are stored and a part of the processed containing solids are burned in the cyclone furnace with the quantity of processed carbon containing solids being stored in accordance with a total energy consumption of the waste treatment process.

15. A process in accordance with claim 7, wherein:

a part of the processed carbon containing solids are stored and a part of the processed containing solids are burned in the cyclone furnace with the quantity of processed carbon containing solids being stored in accordance with a total energy consumption of the waste treatment process.

16. A process in accordance with claim 8, wherein:

a part of the processed carbon containing solids are stored and a part of the carbon containing solids are burned in the cyclone furnace with the quantity of processed carbon containing solids being stored in accordance with a total energy consumption of the waste treatment process.

17. A process in accordance with claim 1, wherein:

the energy recovery device contains effluents containing particles and the effluents are filtered to remove the particles therein; and the removed particles are burned in the cyclone furnace.

18. A process in accordance with claim 2, wherein:

the energy recovery device contains effluents containing particles and the effluents are filtered to remove the particles therein; and the removed particles are burned in the cyclone furnace.

19. A process in accordance with claim 3, wherein:

the energy recovery device contains effluents containing particles and the effluents are filtered to remove the particles therein; and the removed particles are burned in the cyclone furnace.

20. A process in accordance with claim 4, wherein:

the energy recovery device contains effluents containing particles and the effluents are filtered to remove the particles therein; and the removed particles are burned in the cyclone furnace.

21. A process in accordance with claim 5, wherein:

the energy recovery device contains effluents containing particles and the effluents are filtered to remove the particles therein; and the removed particles are burned in the cyclone furnace.

22. A process in accordance with claim 6, wherein:

the energy recovery device contains effluents containing particles and the effluents are filtered to remove the particles therein; and the removed particles are burned in the cyclone furnace.

23. A process in accordance with claim 7, wherein:

the energy recovery device contains effluents containing particles and the effluents are filtered to remove the particles therein; and the removed particles are burned in the cyclone furnace.

24. A process in accordance with claim 8, wherein:

the energy recovery device contains effluents containing particles and the effluents are filtered to remove the particles therein; and the removed particles are burned in the cyclone furnace.

25. A process in accordance with claim 9, wherein:

the energy recovery device contains effluents containing particles and the effluents are filtered to remove the particles therein; and the removed particles are burned in the cyclone furnace.

* * * * *